US006796282B2

(12) United States Patent
Tsubouchi et al.

(10) Patent No.: US 6,796,282 B2
(45) Date of Patent: Sep. 28, 2004

(54) VERTICAL INTERNAL COMBUSTION ENGINE

(75) Inventors: Masanori Tsubouchi, Wako (JP); Tatsuya Kuroda, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 80 days.

(21) Appl. No.: 10/232,936

(22) Filed: Aug. 30, 2002

(65) Prior Publication Data

US 2003/0045184 A1 Mar. 6, 2003

(30) Foreign Application Priority Data

Sep. 3, 2001 (JP) ..... 2001-266232

(51) Int. Cl.[7] ..... F02F 7/00
(52) U.S. Cl. ..... 123/195 C; 123/195 P
(58) Field of Search ..... 123/195 R, 195 A, 123/195 C, 195 P, 90.27, 90.31

(56) References Cited

U.S. PATENT DOCUMENTS 5,489,243 A * 2/1996 Watanabe ..... 123/90.31
6,397,804 B1 * 6/2002 Harada et al. ..... 123/90.16

FOREIGN PATENT DOCUMENTS

| | | |
|---|---|---|
| JP | 2524102 | 1/1987 |
| JP | 63-128 | 1/1988 |
| JP | 2524102 | 5/1996 |

* cited by examiner

*Primary Examiner*—Noah P. Kamen
(74) *Attorney, Agent, or Firm*—MacPherson Kwol Chen & Heid LLP; David S. Park

(57) ABSTRACT

In a vertical internal combustion engine, comprising; a cylinder block; a cylinder head connected to an end of the cylinder block; a crankshaft extending generally vertically and rotatably supported in the cylinder block; a camshaft extending generally in parallel with the crankshaft and rotatably supported in the cylinder head; and a timing belt for connecting pulleys provided to upper end portions of the crankshaft and the camshaft so as to transmit a driving force from the crankshaft to the camshaft, a plate is attached to a top surface of the cylinder block and at least one idle pulley contacting the timing belt is rotatably supported by the plate.

5 Claims, 6 Drawing Sheets

VERTICAL INTERNAL COMBUSTION ENGINE

TECHNICAL FIELD

The present invention relates to a vertical internal combustion engine, and particularly relates to a four-stroke water-cooled vertical internal combustion engine suitable for use in an outboard marine drive.

BACKGROUND OF THE INVENTION

In four-stroke water-cooled vertical internal combustion engines for outboard marine drives, it is necessary to mount various component parts on top of the engine. Such component parts may include a tension pulley that is spring-biased to contact a timing belt, a fixed pulley for guiding or defining the path of the timing belt, component parts for achieving cooling of the engine, such as a thermostat valve, etc. Thus, it is required to provide a sufficient space for mounting these component parts on top of the engine as well as simplify the mounting process thereof.

It is also desired to use manufacturing lines for the mass-produced automobile horizontal engines commonly in manufacturing the vertical engines which are usually produced in a relatively small number, so that the basic design, component parts and/or manufacturing equipment such as machine tools may be used in common, which can bring about significant economical benefits. In such a case, however, some of the parts mounted on the horizontal engine, such as a water pump, may have to be mounted to a different part of the vertical engine. This may leave a large opening in the top surface of the vertical engine which extends to the water jacket, and limit the freedom of parts arrangement on top of the engine to such an extent that the proper arrangement of the component parts becomes difficult.

Conventional embodiments of such engines are disclosed in Japanese Patent Registration No. 2524102 or Japanese Utility Model Application Laid-Open Publication (kokai) No. 63-128, for example.

BRIEF SUMMARY OF THE INVENTION

In view of such problems of the prior art, a primary object of the present invention is to provide an improved water-cooled vertical internal combustion engine in which a sufficient space can be provided for the component parts mounted on top of the engine and the mounting process of such component parts can be simplified.

A second object of the present invention is to provide an improved water-cooled vertical internal combustion engine wherein the parts arrangement on top of the engine can be relatively freely designed even when the vertical engine is manufactured by commonly using a manufacturing line for a horizontal engine.

According to the present invention, such objects can be accomplished by providing a vertical internal combustion engine, comprising; a cylinder block; a cylinder head connected to an end of the cylinder block; a crankshaft extending generally vertically and rotatably supported in the cylinder block; a camshaft extending generally in parallel with the crankshaft and rotatably supported in the cylinder head; and a timing belt for connecting pulleys provided to upper end portions of the crankshaft and the camshaft so as to transmit a driving force from the crankshaft to the camshaft, wherein the engine further comprises a plate attached to a top surface of the cylinder block and at least one idle pulley rotatably supported by the plate and contacting the timing belt.

In this way, it is possible to attach the at least one idle pulley to the plate to form a sub-assembly, and then attach the sub-assembly to the top of the engine, which can significantly simplify and facilitate the mounting of the pulley(s) to the top of the engine.

When the cylinder block has a water jacket for cooling the engine, it is preferable that the plate sealably closes an opening formed in the top surface of the cylinder block and extending to the water jacket. Such an opening may be formed when a manufacturing line for a horizontal engine is commonly used in manufacturing the vertical engine due to a different mounting position of a water pump, for example. Thus, by sealably covering the opening by the plate for supporting the idle pulley(s), it is facilitated to manufacture the vertical engine by commonly using the horizontal engine. The opening of the cylinder block may accommodate a component part, such as a thermostat valve, of a water cooling system so that the opening is effectively used.

The at least one idle pulley may comprise a spring-biased tension pulley and/or a fixed belt guiding pulley. Preferably, the at least one idle pulley comprises more than one idle pulley. In this way, it is possible to mount the more than one pulley to the cylinder block by attaching the common supporting plate to the cylinder block. This can reduce the number of required bolts for attachment and thus reduce the space required for them, which can leave a larger space for idle pulley arrangement to thereby facilitate the arrangement of such component parts.

The engine typically consists of a four-stroke V-type internal combustion engine suitable for an outboard marine drive.

Other and further objects, features and advantages of the invention will appear more fully from the following description.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
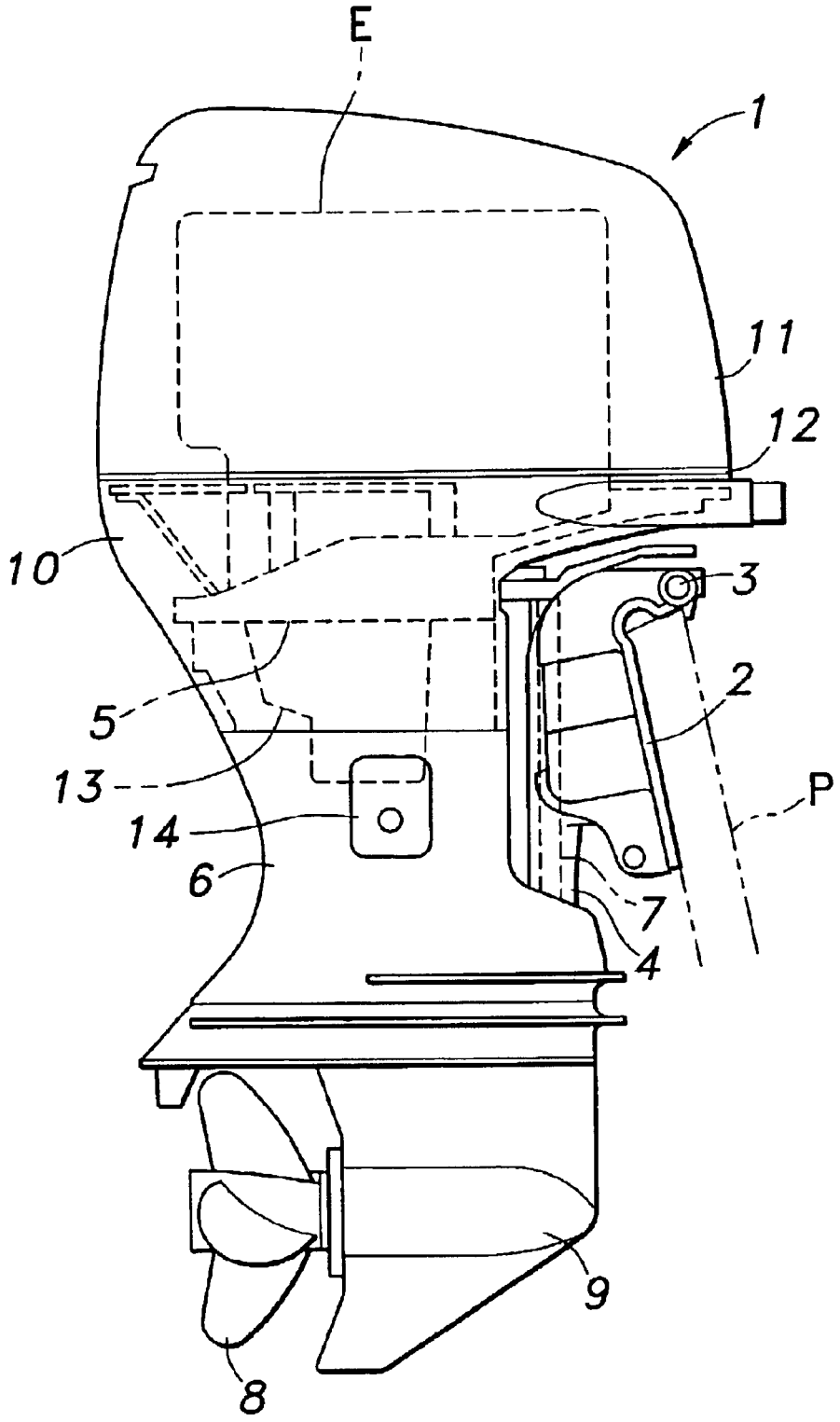
FIG. 1 is a general side view of an outboard marine drive to which the present invention is applied.

FIG. 1 is a side view for generally showing an outboard marine drive to which the present invention is applied. This outboard marine drive 1 is secured to a stern plate P of a watercraft such as a boat via a stern bracket 2.

A swivel case 4 is coupled to the stern bracket 2 so as to be tiltable around a laterally extending tilt shaft 3. An upper end of the swivel case 4 is connected to a front end of an engine mount case 5 while a lower end of the swivel case 4 is connected to an extension case 6 accommodating a drive shaft therein so that the engine mount case 5 and the extension case 6 can pivot around a vertically extending swivel shaft 7.

The engine mount case 5 is connected to an upper end of the extension case 6, and a lower end of the extension case 6 is connected to a gear case 9 supporting a propeller 8. The engine mount case 5, a lower part of an internal combustion engine E mounted on the engine mount case 5, and an upper part of the extension case 6 are covered by an under cover 10. An engine cover 11 having a deep bowl-like shape with an opening formed at its underside is detachably attached to an upper opening rim of the under cover 10 to cover an upper part of the engine E.

In order to prevent intrusion of water through the contacting surfaces of the under cover 10 and the engine cover 11, a seal rubber 12 is interposed between the opening rims of the under cover 10 and the engine cover 11, and a lock device (not shown) provided near the contacting portions of these covers 10, 11 holds them in the engaged state.

An oil pan 13 for storing an lubricating oil is attached to a lower end of the engine mount case 5. In order to allow an access to a drain plug DP (see FIG. 3) provided in a bottom portion of the oil pan 13, a side of the extension case 6 is formed with an opening 14 which is normally closed by a lid.

Figure 2:
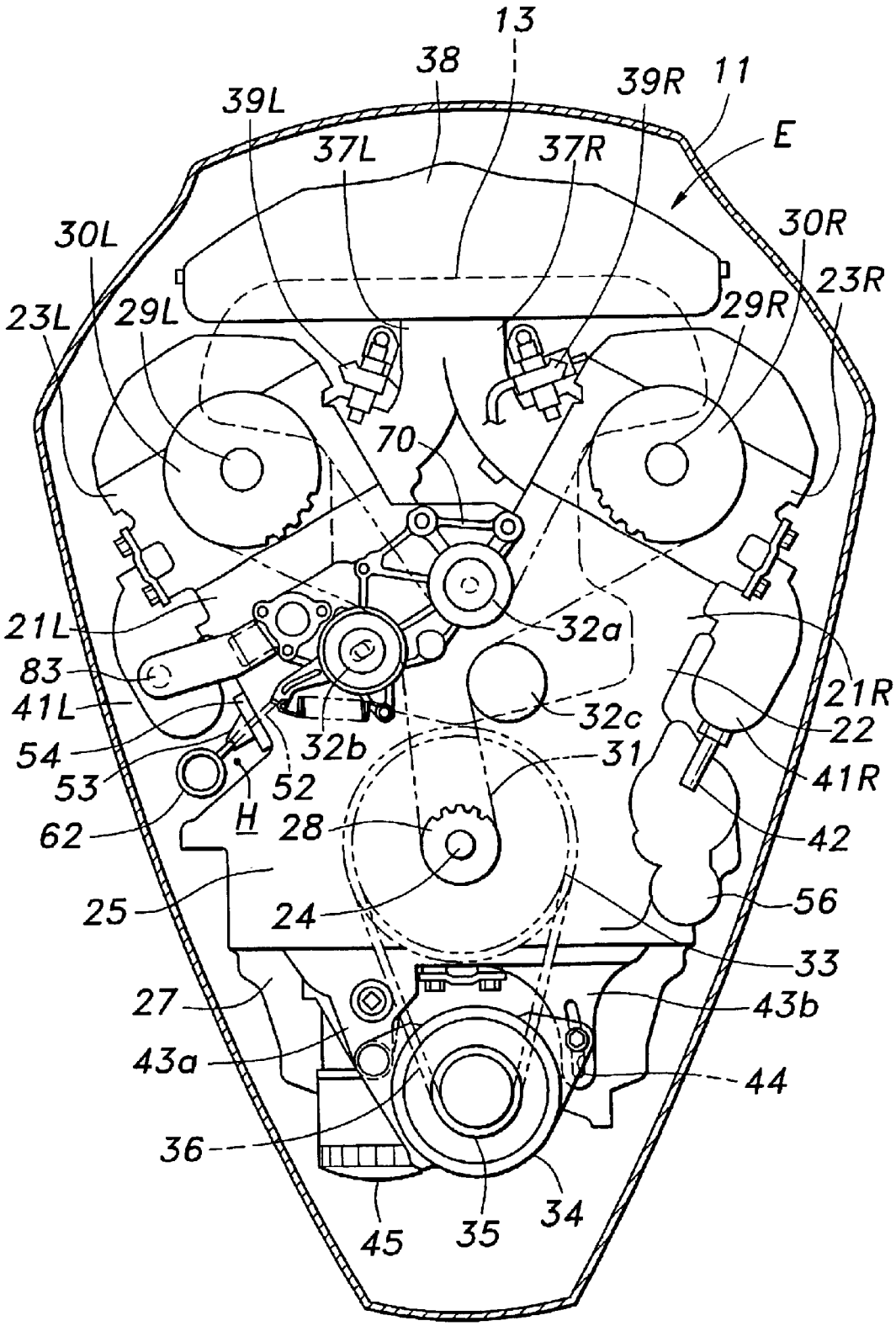
FIG. 2 is a top plan view of a part of the outboard marine drive where an engine according to the present invention is mounted.
Figure 3:
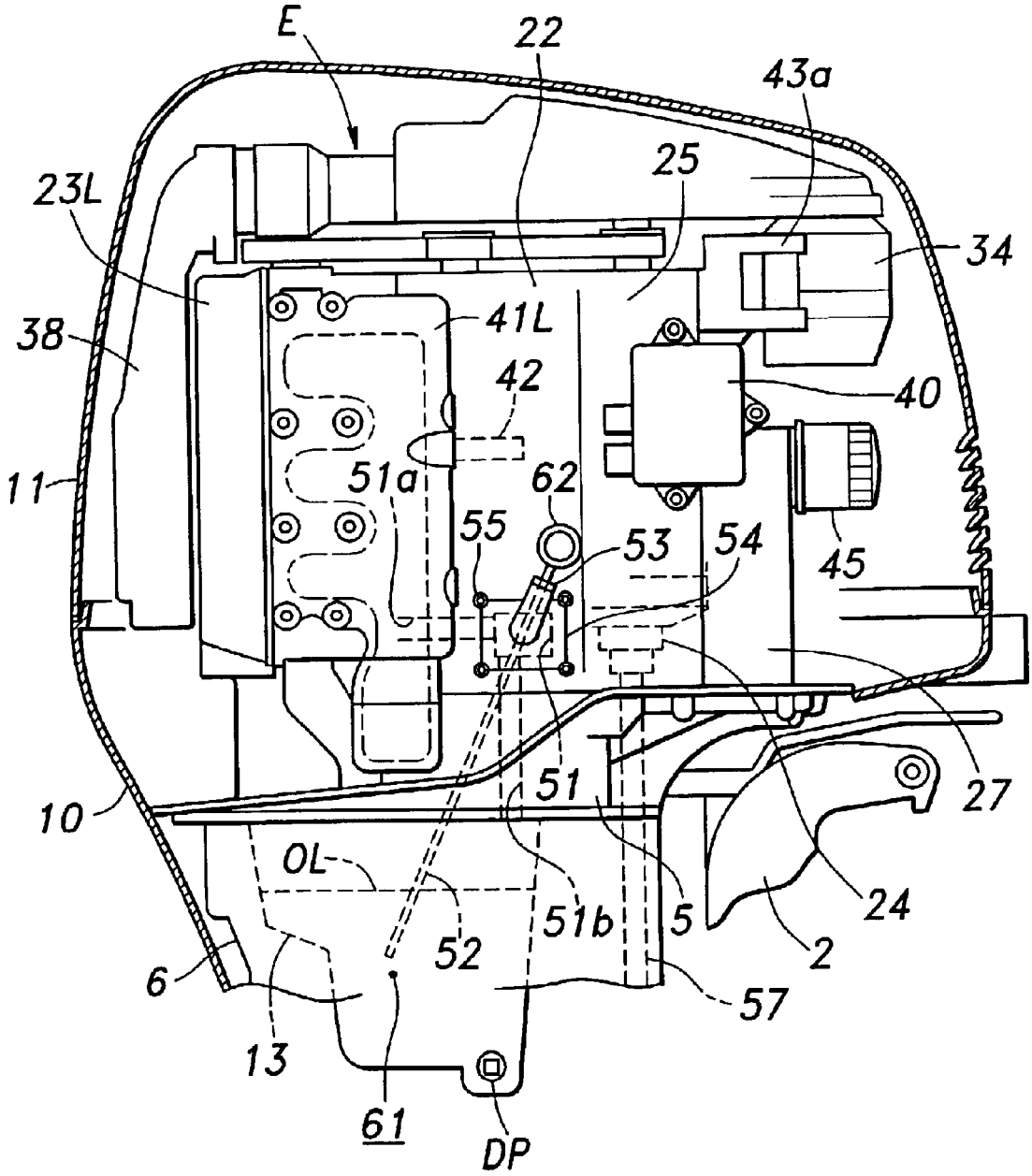
FIG. 3 is a side view of the part of the outboard marine drive where the engine according to the present invention is mounted.

FIGS. 2 and 3 show the vertical-crankshaft, four-stroke, V-type, six-cylinder engine E mounted in the outboard marine drive 1. This engine E comprises a cylinder block 22 having a pair of cylinder banks 21L, 21R, and a pair of cylinder heads 23L, 23R joined to a rear end of the cylinder block 22. The cylinder block 22 also has a skirt portion 25 unitarily formed in a front portion thereof to constitute part of a crankcase that accommodates a crankshaft 24, and a crankcase member 27 is joined to a front end of the skirt portion 25.

A camshaft driving pulley 28 is secured to an upper end of the vertically arranged crankshaft 24, and camshaft driven pulleys 30L, 30R are secured to an upper end of a pair of camshafts 29L, 29R supported by the associated cylinder heads 23L, 23R, respectively, to operate engine valves. An endless timing belt 31, which is wound around the camshaft driving pulley 28 and the camshaft driven pulleys 30L, 30R, is guided and given a prescribed tension by three idle pulleys comprising a pair of fixed belt guiding pulleys 32*a*, 32*c* and a spring-biased tension pulley 32*b*.

An electric generator driving pulley 33 is also secured to the upper end portion of the crankshaft 24, and an electric generator driving endless belt 36 is wound around the driving pulley 33 and a driven pulley 35 which is secured to an input shaft of an electric generator 34 fixedly attached to a front side of the crankcase member 27.

On a side of the mutually facing inward surfaces of the pair of cylinder heads 23L, 23R is provided a common air intake device 38 which is connected to the cylinder banks 21L, 23R via intake manifolds 37L, 37R, respectively. Each intake manifold 37L, 37R is provided with a fuel injection valve 39L, 39R. These fuel injection valves 39L, 39R are controlled by an electronic control device 40, which is attached to a side surface of the skirt portion 25, in such a manner that the control device 40 conducts computation based on various sensor signals so as to optimize the amount of fuel injection.

On an outward side surface of each cylinder head 23L, 23R is provided an associated exhaust manifold 41L, 41R. Although not clearly shown in the drawings, the combustion gas discharged from the exhaust manifolds 41L, 41R will flow through a passage provided in the engine mount case 5 into the extension case 6. On the front side of one exhaust manifold 41R (the right one in FIG. 2), at a middle portion in the direction of the crankshaft extension, is mounted an oxygen concentration sensor 42. Thus, by arranging the oxygen concentration sensor 42 so as to assume a forwardly oriented posture, it is possible to minimize an amount of projection of the oxygen concentration sensor 42 from an outer envelope of the engine E.

The crankcase member 27 is unitarily formed with forwardly projecting brackets 43*a*, 43*b* by casting so that the electric generator 34 can be mounted thereto. One lateral end of the electric generator 34 is supported by one bracket 43*a* so as to be pivotable around a vertical axis, and the other lateral end of the electric generator 34 is secured to the other bracket 43*b* by using an arcuate slot 44 which corresponds to a pivot path taken by the other lateral end of the electric generator 34. Further, an oil filter 45 is attached to the front surface of the crankcase member 27 at a position below the electric generator 34.

At a part of one (for example, the left one in FIG. 2) of the left and right sidewalls of the cylinder block 22 adjacent the skirt portion 25, a cast hole 51 is opened as a result of formulation of return passages 51*a*, 51*b* through which the lubricant oil is allowed to return from the cam chambers defined by the cylinder heads 23L, 23R to the oil pan 13. In other words, the cast hole 51 defines a part of the oil return passage 51*a*, 51*b*. The cast hole 51 is closed by a plate 54 secured to the cylinder block 22 with bolts 55, and the plate 54 is provided with a tube-like receptacle 53 through which a stick-shaped oil level gauge 52 is guidedly inserted toward the oil pan 13. The plate 54, which is provided with the oil level gauge receptacle 53*a* and separate from the engine main body, can facilitate designing the vertical engine using the basic design of a horizontal engine, in which the oil pan and the drain hole may be provided at a different position.

On the other side (or right side in FIG. 2) of the skirt portion 25, a starter motor 56 is mounted.

The oil pan 13 is located at a position beneath the cylinder block 22 and offset towards the cylinder heads 23L, 23R so as to avoid interfering with a drive shaft 57 that extends vertically along the axis of the crankshaft 24. Further, the axis of the oil level gauge 52 inserted through the oil level gauge receptacle 53 is inclined so that the oil level gauge 52 extends from a central portion 61 of a main reservoir part of the oil pan 13 upwardly in a forward and outward direction. The axis of the oil level gauge 52 thus inclined allows a handle 62 of the oil level gauge 52 to be positioned close to the stern plate P and above the opening rim surface of the under cover 10 to which the engine cover 11 is engaged, allowing a user to easily access the oil level gauge. Further, since the handle 62 of the oil level gauge 52 is inclined forwardly and outwardly, the user can easily pull out and insert the oil level gauge 52 from and into the insertion hole 51. Moreover, the handle 62 is placed in a recess H formed on the side of the cylinder block 22 between the skirt portion 25 and the cylinder bank 21L, and thus would not be obstructive.

FIGS. 4–7 show in detail a supporting structure for the fixed belt guiding pulley 32*a* and the spring-biased tension pulley 32*b*. The supporting structure comprises a cast aluminum alloy plate 70 for supporting the belt guiding pulley 32*a* and the tension pulley 32*b*. A thermostat valve 74, which extends into an opening 71 formed in the cylinder block 22 toward a water jacket, is also sealably supported by the plate 70.

Figure 5:
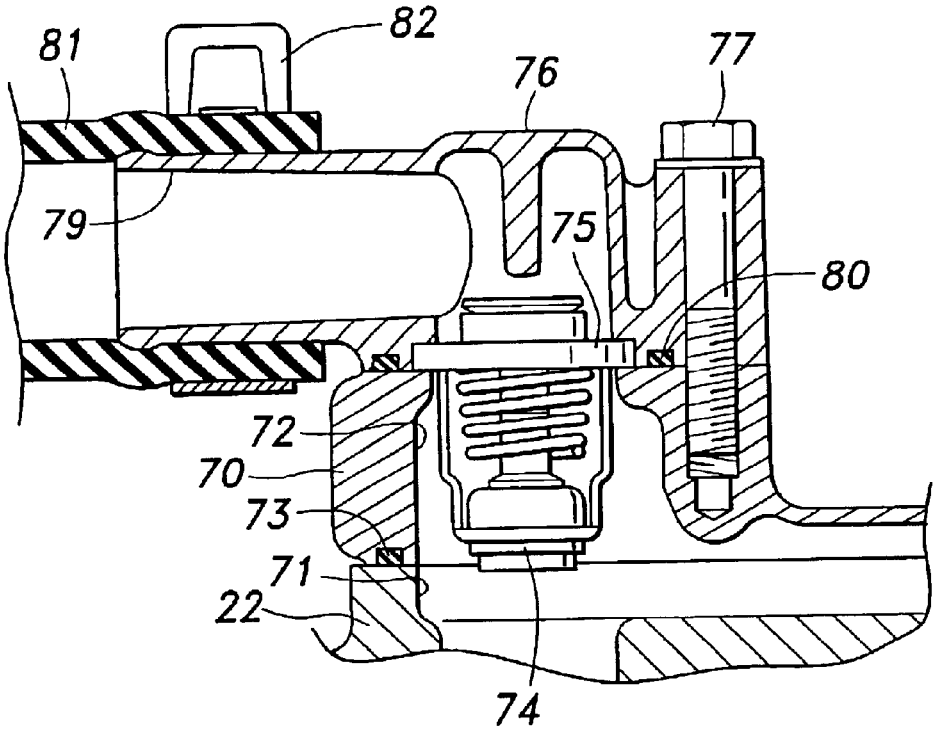
FIG. 5 is a cross-sectional view taken along the lines V—V in FIG. 4.

As best shown in FIG. 5, the plate 70 has an opening 72 aligned with the opening 71 extending to the water jacket, and the plate 70 contacts un upper surface of the cylinder block 22 with an O-ring 73 extending along a lower rim of the opening 72 interposed therebetween so that the openings 71 and 72 are water-tightly connected to each other. The thermostat valve 74 is accommodated inside the opening 72 with its flange 75 engaging an upper rim of the opening 72. A thermostat cover 76 is attached to an upper surface of the plate 70 with another O-ring 80 interposed therebetween in such a manner that the thermostat cover 76 presses the flange 75 and close the opening 72. One securing bolt 77 for the thermostat cover 76 only serves to connect the thermostat cover 76 to the plate 70, while other two securing bolts 78 secure both the thermostat cover 76 and the plate 70 to the cylinder block 22. The thermostat cover 76 is formed with an integral outlet nozzle 79. After warming up, when the thermostat valve 74 opens, the cooling water flows from the water jacket to the outlet nozzle 79 through inside of the thermostat cover 76, and then passes through a hose 81 connected to the outlet nozzle 79 by means of a hose clamp 82 to reach a cooling water passage 83 (FIG. 2) defined in the exhaust manifold 41L, and from which is discharged to the body of water outside of the watercraft.

Figure 6:
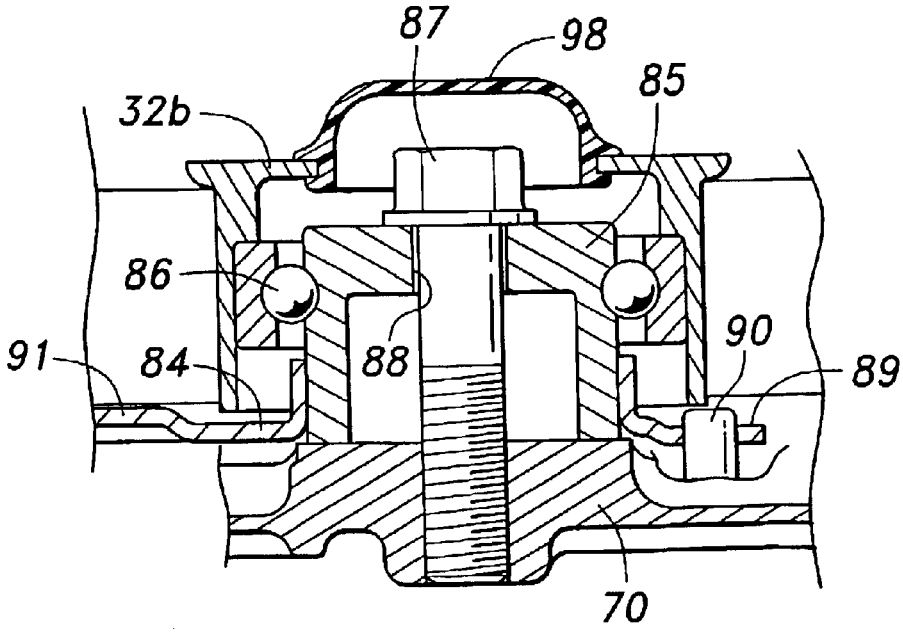
FIG. 6 is a cross-sectional view taken along the lines VI—VI in FIG. 4.

As best seen in FIG. 6, the spring-biased tension pulley 32*b* is attached to an outer race of a ball bearing 86 having an inner race 85 consisting of a cup-shaped member, so as to allow rotation of the tension pulley 32*b*. The cup-shaped member 85 is formed with a slot 88 at its center through which a bolt 87 extends and is threadedly engages the plate 70 to prevent detachment of the cup-shaped member 85 while allowing a movement of the cup-shaped member 85 parallel to the plate 70 within a range defined by the slot 88. A plastic plug cap 98 is attached to the tension pulley 32*b* to hide the bolt 87.

Figure 4:
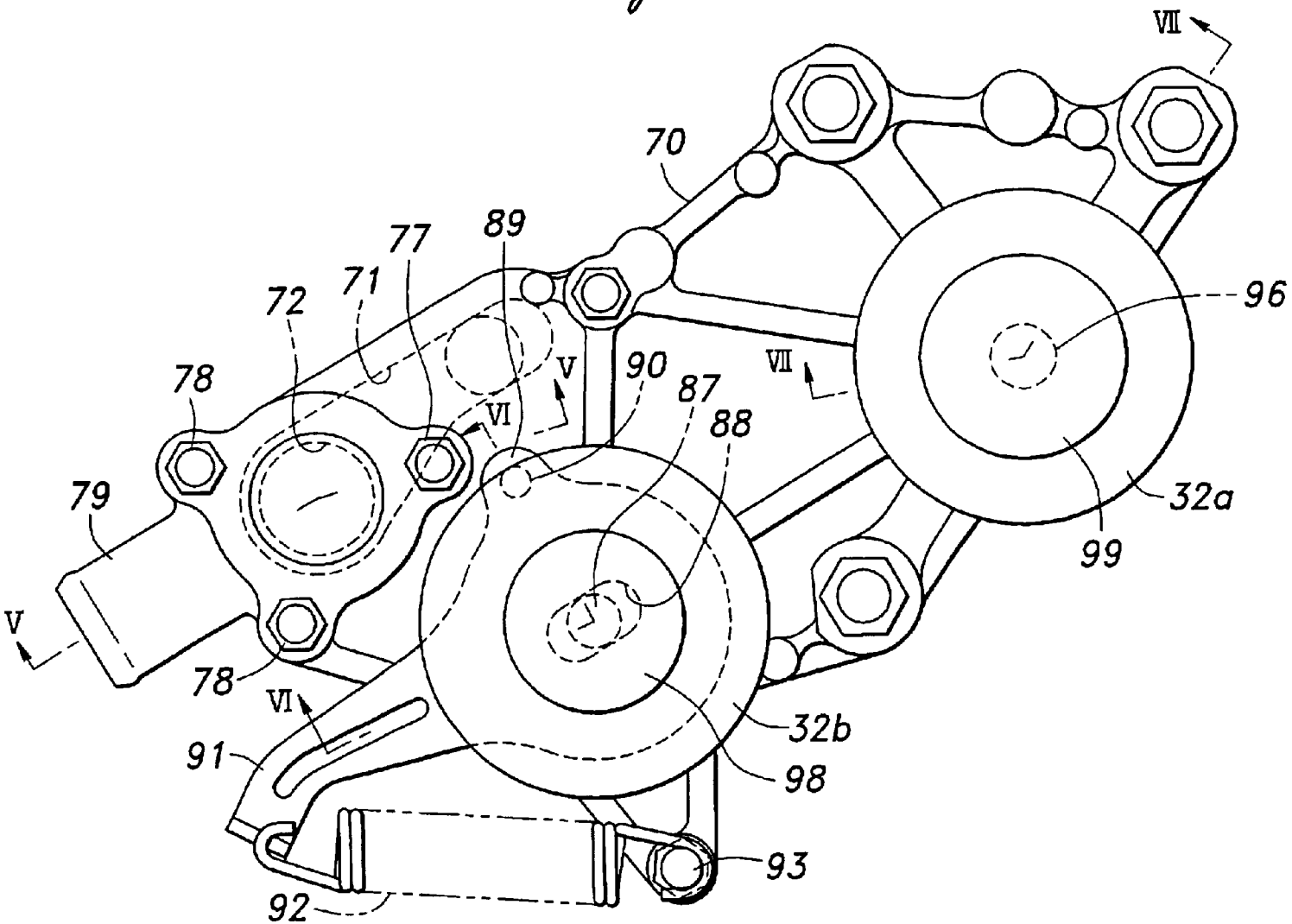
FIG. 4 is an enlarged top plan view of a plate attached to a top surface of the cylinder block of the engine.

A base 84 consisting of a metallic plate is interposed between the pulley 32*b* and the plate 70. A lower part of the cup-shaped member 85 is tightly fitted into a collar of the base 84. The base 84 has a tongue 89 extending out in a radial direction and supported by a pin 90 projecting from the plate 70 so that the base 84 can rotate about an axis perpendicular to a plane of the plate 70. The base 84 has another extension 91 extending radially outwardly from a part different from that where the tongue 89 is formed, and a tension coil spring 92 connects an end of the extension 91 to a pin 93 projecting upwardly from the plate 70 (FIG. 4).

In this way, the tension pulley 32*b* is caused to elastically contact an outer side of the timing belt 31 under the force of the tension coil spring 92, to achieve adjustment of the tension of the timing belt 31 within a range defined by the slot 88.

Figure 7:
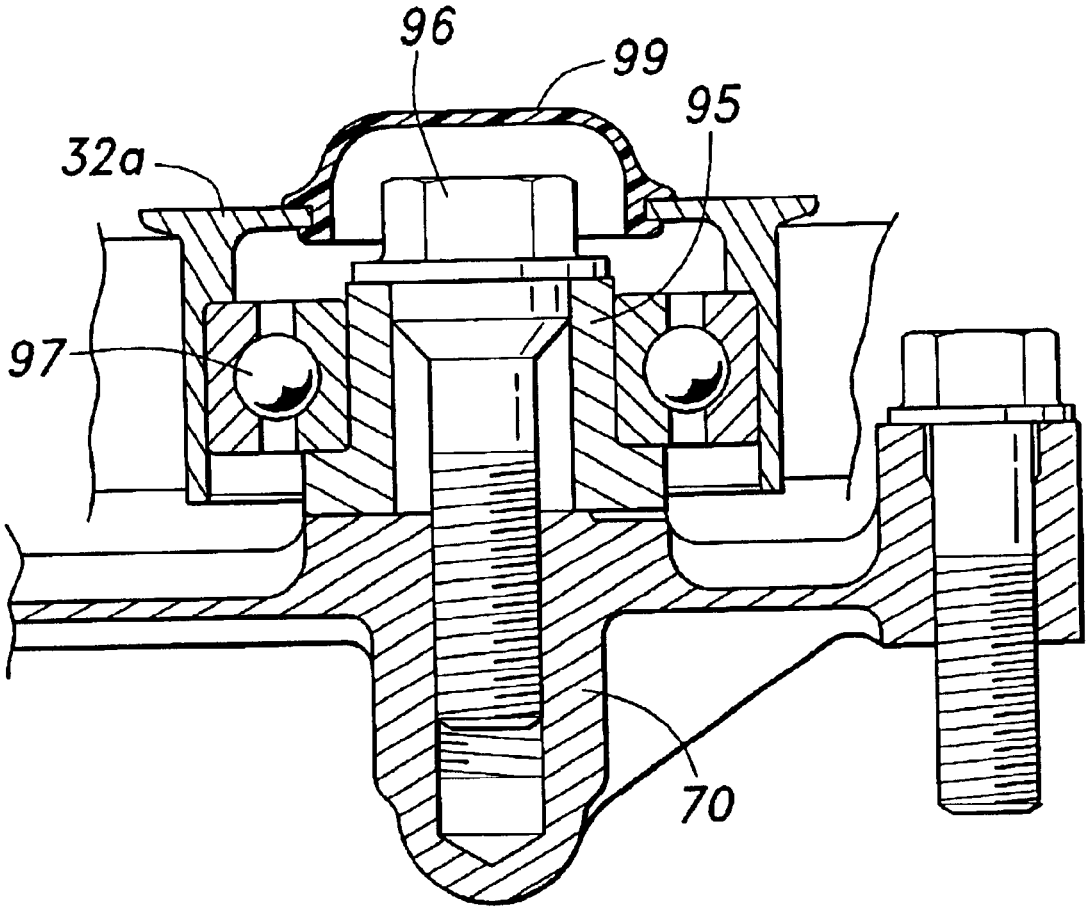
FIG. 7 is a cross-sectional view taken along the lines VII—VII in FIG. 4.

As best shown in FIG. 7, the fixed belt guiding pulley 32*a* is rotatably attached to a ball bearing 97 attached to an outer circumferential surface of a collar member 95 which in turn is fixed to the plate 70 by means of a bolt 96. In this way, the belt guiding pulley 32*a* serves to define the path of the timing belt 31. A plastic plug cap 99 is attached to the belt guiding pulley 32*a* to hide the bolt 96.

The internal combustion engine shown in the drawings consists of a V-type internal combustion engine in that the cylinder banks 21L, 21R are somewhat offset with respect to each other in a direction of the axis of the crankshaft 24. Specifically, the right cylinder bank 21R in FIG. 2 is placed at a higher position than the left cylinder bank 21L. However, the timing belt 31 substantially extends in a single plane, and thus, it is necessary to align the heights of the idle pulleys 32*a*, 32*b* and 32*c*. In the shown embodiment, the thickness of the plate 70 is properly varied so as to compensate the difference in the vertical positions of the cylinder banks 21L, 21R, and therefore, it is possible to align the heights or vertical positions of the idle pulleys 32*a*, 32*b* and 32*c* even when the parts of the idle pulley supporting bolts extending above the surface of the plate 70 have the same length.

Thus, according to the present invention, the tension pulley and/or belt guiding pulley are attached to the plate which was conventionally used only to close the opening of the cylinder head formed for mounting the parts for engine cooling or as a result of casting process. This makes it possible to attach the pulley(s) to the plate to form a sub-assembly, and then attach the sub-assembly to the top of the engine, which can significantly simplify and facilitate the mounting of the pulley(s) to the top of the engine.

Although the present invention has been described in terms of a preferred embodiment thereof, it is obvious to a person skilled in the art that various alterations and modifications are possible without departing from the scope of the present invention which is set forth in the appended claims.

What is claimed is:

1. A vertical internal combustion engine, comprising;

a cylinder block internally defining a water jacket;

a cylinder head connected to an end of the cylinder block;

a crankshaft extending generally vertically and rotatably supported in the cylinder block;

a camshaft extending generally in parallel with the crankshaft and rotatably supported in the cylinder head; and a timing belt for connecting pulleys provided to upper end portions of the crankshaft and the camshaft so as to transmit a driving force from the crankshaft to the camshaft, wherein the engine further comprises a plate attached to a top surface of the cylinder block to sealed close an opening formed in a top surface of the cylinder block and extending to the water jacket and at least one idle pulley rotatably supported by the plate and contacting the timing belt, the opening of the cylinder block accommodating a thermostat valve for a water cooling system of the engine.

2. A vertical internal combustion engine according to claim 1, wherein the at least one idle pulley comprises a spring-biased tention pulley.

3. A vertical internal combustion engine according to claim 1, wherein the at least one idle pulley comprises a fixed belt guiding pulley.

4. A vertical internal combustion engine according to claim 1, wherein the at least one idle pulley comprises more than one idle pulley.

5. A vertical internal combustion engine according to claim 1, wherein the engine consists of a four-stroke V-type internal combustion engine.

* * * * *